United States Patent [19]

Asakura

[11] Patent Number: 4,853,664

[45] Date of Patent: Aug. 1, 1989

[54] THREE-PHASE TRANSFORMER FOR CYCLOCONVERTER

[75] Inventor: Masakatsu Asakura, Ako, Japan

[73] Assignee: Mitsubishi Denki Kabushiki Kaisha, Japan

[21] Appl. No.: 112,215

[22] Filed: Oct. 26, 1987

[30] Foreign Application Priority Data

Dec. 22, 1986 [JP] Japan ..... 61-303816

[51] Int. Cl.[4] ..... H01F 33/00

[52] U.S. Cl. ..... 336/12; 363/160

[58] Field of Search ..... 336/5, 10, 12, 183, 336/181; 363/64, 171, 160; 323/361

[56] References Cited

U.S. PATENT DOCUMENTS

| | | | |
|---|---|---|---|
| 2,024,739 | 12/1935 | Maslin et al. | 363/64 |
| 2,374,029 | 4/1945 | Maslin | 336/12 |
| 4,112,403 | 9/1978 | Friedlander | 336/12 |

FOREIGN PATENT DOCUMENTS

| | | | |
|---|---|---|---|
| 497695 | 3/1976 | U.S.S.R. | 363/171 |
| 811446 | 3/1981 | U.S.S.R. | 363/17 |
| 836737 | 6/1981 | U.S.S.R. | 363/171 |
| 983937 | 12/1982 | U.S.S.R. | 363/171 |
| 1179496 | 9/1985 | U.S.S.R. | 363/171 |
| 1056393 | 11/1985 | U.S.S.R. | 363/171 |

OTHER PUBLICATIONS

"AC Adjustable-Speed Main Drives for Rolling Mills", Hitachi Review, vol. 67, Apr. 1985, pp. 53-56.

"Cycloconverter and Its Application", Hakata et al., Toshiba Review, 1984, pp. 1027-1030.

*Primary Examiner*—Thomas J. Kozma

*Attorney, Agent, or Firm*—Leydig, Voit & Mayer

[57] ABSTRACT

A three-phase transformer for a cycloconverter comprising three primary windings to which three-phase currents of U-, V- and W-phase are individually applied as inputs, and six secondary windings which are provided for each of the primary windings and so arranged that D.C. components contained in six sets of three-phase signals delivered from the secondary windings are canceled in the respective phases, thereby to prevent D.C. components from being contained in currents which are supplied to the primary winding wound around the main legs of an iron core for the respective phases.

3 Claims, 4 Drawing Sheets

THREE-PHASE TRANSFORMER FOR CYCLOCONVERTER

BACKGROUND OF THE INVENTION

This invention relates to a three-phase transformer which is used for a cycloconverter having a conversion frequency lower than a source frequency. More particularly, it relates to a three-phase transformer for a cycloconverter which does not undergo D.C. excitation even when an output frequency is set at ½ of an input frequency.

Heretofore, cycloconverters which can convert a source frequency of 50 Hz–60 Hz into an output frequency of several to 20 Hz have been employed for speed control on electric railways, in induction motors and the like.

FIG. 3 is a connection diagram showing a prior-art three-phase transformer system for a cycloconverter illustrated in, for example, "Denki-Kogaku Handbook (Handbook Of Electrical Engineering)," (issued by Denki Gakkai in 1971), page 714, Section 6. 4. 3, FIG. 168.

Referring to FIG. 3, each of the three three identical-phase transformers 1–3 includes a primary winding 4, and secondary windings 5 and 6 magnetically coupled therewith. Although depicted as a single winding in FIG. 3, each of the primary winding 4 and the secondary windings 5 and 6 is composed of three windings corresponding to respective phases U, V and W as will be stated later.

Three cycloconverter circuits of identical arrangement 7–9 are individually connected to the respective three-phase transformers 1–3. Each of the cycloconverter circuits 7–9 includes a positive group converter 10 and a negative group converter 11 which are respectively formed of thyristor circuits, and a circulating current reactor 12 which is connected in series with both the converters 10 and 11. In addition, three-phase outputs Iu–Iw from the respective cycloconverter circuits 7–9 are supplied to a three-phase induction motor (not shown).

FIG. 4 is a side sectional view showing the winding structure of one of the three-phase transformers in FIG. 3.

Referring to FIG. 4, the iron core 13 of a three-phase three-leg structure has three main legs 13U–13W which correspond to the U-phase, V-phase and W-phase, respectively. The primary windings 4U–4W of the respective phases individually wound around the main legs 13U–13W constitute the primary winding 4. The secondary windings 5U–5W and 6U–6W of the respective phases wound around the corresponding main legs 13U–13W constitute the secondary windings 5 and 6.

Each of the primary windings 4U–4W of the respective phases is divided into two sets. These sets are excited in parallel, and one of them is magnetically coupled to the secondary windings 5U–5W, while the other to the secondary windings 6U–6W.

The respective phases of each of the secondary windings 5 and 6 are delta-connected or star-connected to construct corresponding terminals which deliver three-phase signals U1–W1 and U2–W2. By way of example, the secondary winding 5U of the U-phase, the secondary winding 5V of the V-phase and the secondary winding 5W of the W-phase are delta-connected so as to deliver the three-phase outputs U1–W1 from the respective nodes of the delta connection.

Now, there will be described the operation of the prior-art three-phase transformer for the cycloconverter shown in FIGS. 3 and 4.

First, when three-phase currents IU–IW at a source frequency of 60 Hz are supplied to the primary winding 4 of the three-phase transformer 1, the primary windings 4U–4W of the respective phases are excited, and the three-phase signals U1–W1 and U2–W2 are respectively delivered from the corresponding secondary windings 5U–5W and 6U–6W. The three-phase signals U1–W1 derived from one secondary winding 5 are supplied to the positive group converter 10, while the three-phase signals U2–W2 derived from the other secondary winding 5 are supplied to the negative group converter 11.

The respective three-phase signals U1–W1 and U2–W2 are subjected to rectification and duty factor controls by thyristors included in the corresponding converters 10 and 11. Further, the resulting signals are converted into a desired frequency by the circulating current reactor 12 so as to produce the signal-phase output Iu of the U-phase.

Likewise, three-phase signals U3–W3 and U4–W4 from the three-phase transformer 2 are converted into the signal-phase output Iv of the V-phase by the cycloconverter circuit 8, and three-phase signals U5–W5 and U6–W6 from the three-phase transformer 3 are converted into the signal-phase output Iw of the W-phase by the cycloconverter circuit 9. The single-phase output Iu–Iw form three-phase outputs having phase differences of 120° from one another, and are used from the speed control of the induction motor.

FIG. 5 is a waveform diagram for explaining the process in which one of the single-phase outputs is obtained. When an A.C. input voltage as shown in FIG. 5 is supplied as a three-phase current IU–IW, signals depicted as output voltages (hatched parts) are provided from the respective converters 10 and 11. These output voltages are accordingly derived through the circulating current reactor 12, whereby a single-phase output as indicated by an output fundamental wave voltage is obtained. In this case, the output frequency fo of each of the single-phase outputs Iu–Iw becomes ⅓ of the input frequency fi of the three-phase currents IU–IW. Therefore, assuming by way of example that the input frequency fi is 60 Hz, the output frequency fo is 20 Hz.

With the operation control system employing such three-phase outputs Iu–Iw, however, when the output frequency fo is about ½ of the input frequency fi, D.C. components are respectively generated in the three-phase signals U1–W1, . . . and U6–W6, These D.C. components also add to the three-phase currents IU–IW to be supplied to the primary windings 4U–4W of each of the three-phase transformers 1–3. Accordingly, each of the three-phase transformers 1–3 undergoes D.C. excitation, The main legs 13U–13W of the iron core 13 become saturated, with the result that the primary windings 4U–4W and the secondary windings 5U–5W and 6U–6W wound around these main legs 13U–13W are adversely affected electromagnetically and mechanically by overheating of the iron core 13, rush currents, etc.

In order to prevent this drawback, the system has heretofore been operated so that the output frequency fo for the speed control may have the following relation to the input frequency fi:

$f < fi/2$ fo may be 0–25 Hz or so for a 60 Hz fi. In a case where the speed control range of a load such as an induction motor is to be expanded, speed changes have been performed using gears.

As thus far described, prior-art three-phase transformers for cycloconverters have produced the single-phase ouputs Iu–Iw of the respective phases by the use of the three three-phase transformers 1–3. Accordingly, there has been the problem that, when it is intended to obtain the three-phase outputs Iu–Iw whose output frequency fo is higher than 25 Hz, the D.C. excitation causes magnetic saturation in the iron cores 13 of the respective three-phase transformers 1–3 and renders the operation difficult. Another problemhas been that, when the speed range of the controlled system is to be broadened, gears must be used incurring increases in the cost of the overall apparatus and increases in labor for the maintenance of the moving parts.

SUMMARY OF THE INVENTION

This invention has the objective of eliminating the problems as stated above, and has for its main object the provision a three-phase transformer arrangement for a cycloconverter which does not develop D.C. excitation in the main legs within an iron core even when operated so that the output frequency of the cycloconverter is ½ of the input frequency.

The three-phase transformer arrangement for a cycloconverter according to this invention includes three primary windings to which three-phase currents are individually applied each of the primary windings being furnished with six secondary windings.

In this invention, D.C. components in the respective three-phase signals delivered from the secondary windings are cancelled, so as to prevent D.C. components in the currents which are supplied to the primary winding wound around the main legs of respective phases.

DESCRIPTION OF THE PREFERRED EMBODIMENT

Figure 1:
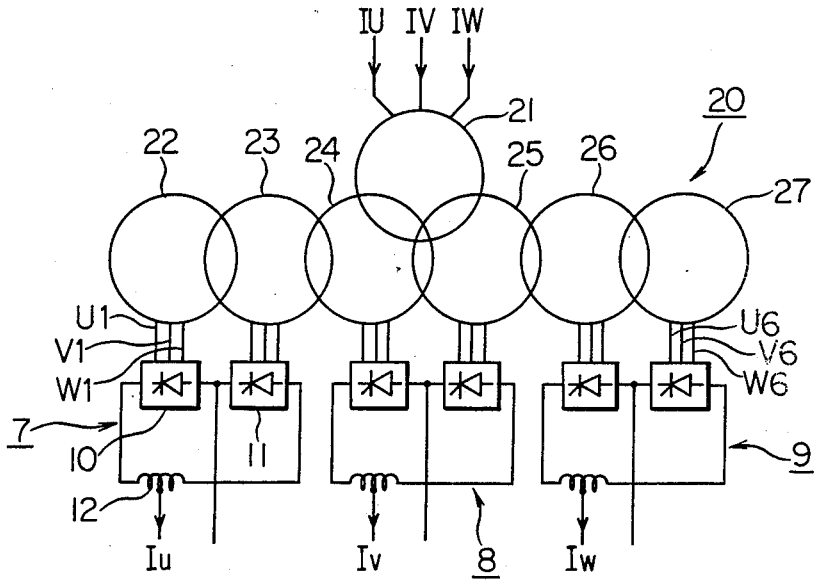
FIG. 1 is a connection diagram showing an embodiment of this invention.
Figure 3:
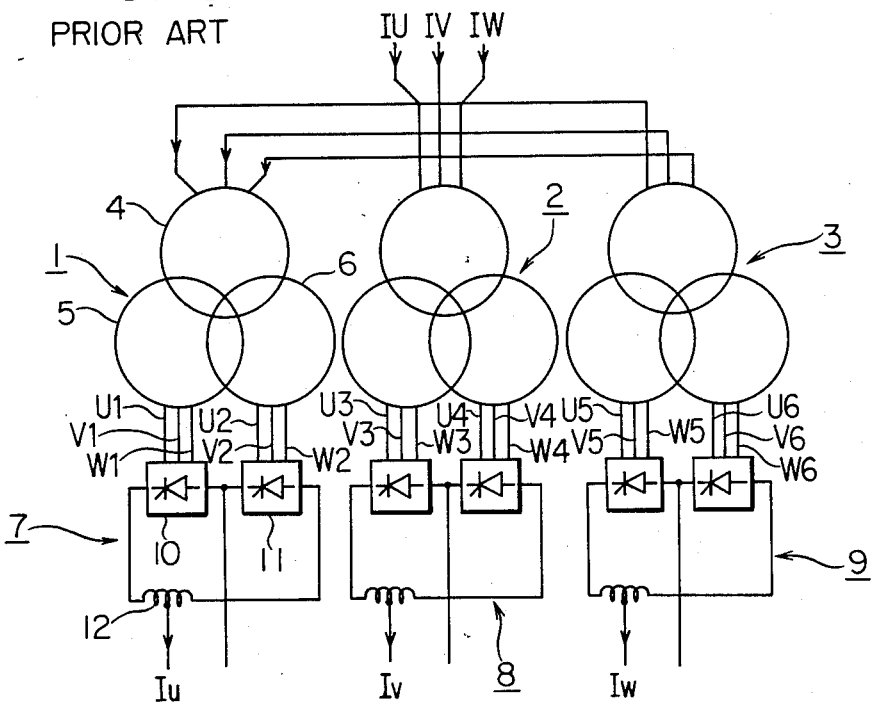
FIG. 3 PRIOR ART
FIG. 3 is a connection diagram showing a prior-art three-phase transformer for a cycloconverter.
Figure 2:
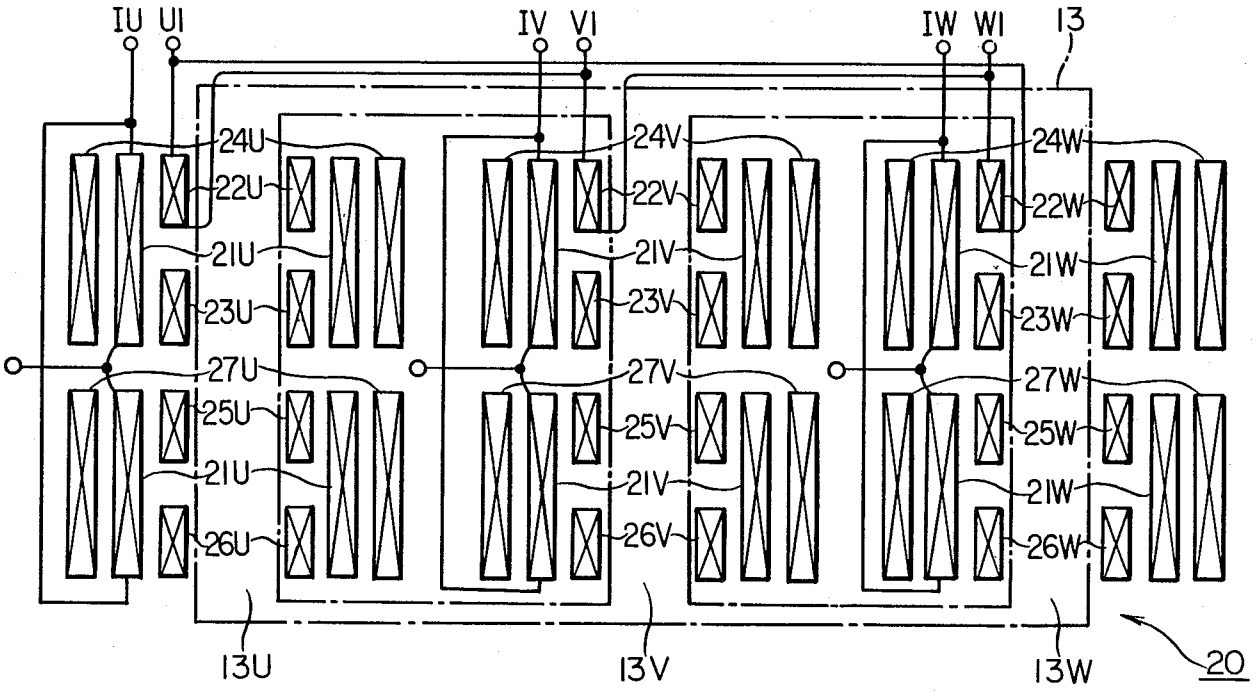
FIG. 2 is a side sectional view showing the winding structure of a three-phase transformer in accordance with the invention.
Figure 4:
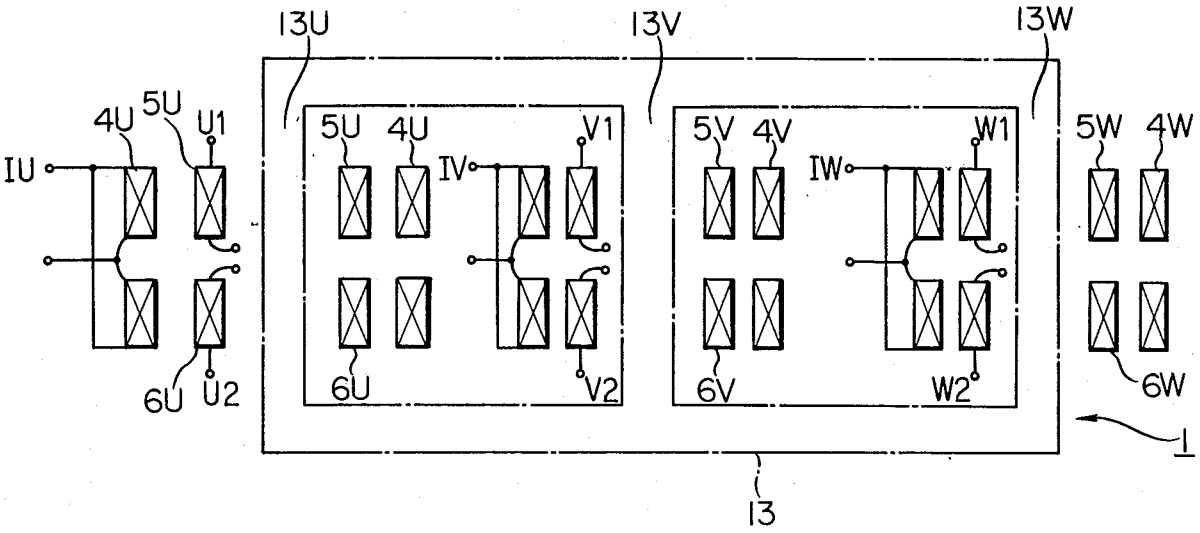
FIG. 4 PRIOR ART
FIG. 4 is a side sectional view showing the winding structure of a three-phase transformer used in the cycloconverter of FIG. 3.
Figure 5:
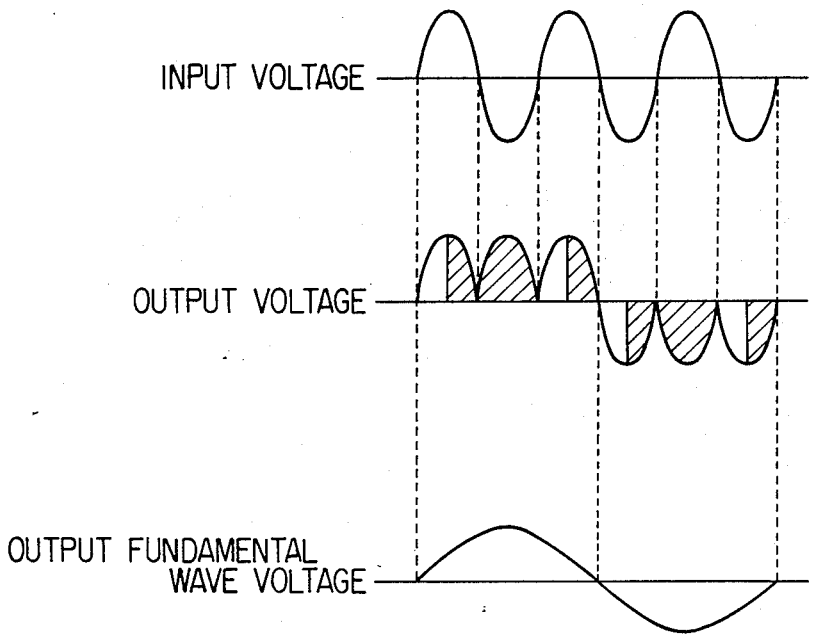
FIG. 5 PRIOR ART
FIG. 5 is a waveform diagram for explaining the operation of a conventional cycloconverter circuit.

Now, an embodiment of this invention will be described with reference to the drawings. FIG. 1 is a connection diagram showing one embodiment of this invention, while FIG. 2 is a side sectional view showing the winding structure of a three-phase transformer according to the invention. Elements 7–13 in these figures are similar to the respective constituents described before.

A three-phase transformer 20 has seven windings, which comprise one primary winding 21 and six secondary windings 22–27 magnetically coupled therewith.

The primary winding 21 and the secondary windings 22–27 are respectively composed of three primary windings 21U–21W and secondary windings 22U–22W, . . . and 27U–27W which correspond to phases U, V and W, and which are wound around the main legs 13U–13W of the respective phases as shown in FIG. 2. Further, each of the primary windings 21U–21W of the respective phases is divided into two sets. These sets are excited in parallel, and one of them is magnetically coupled to the secondary windings 22–24, while the other to the secondary windings 25–27. Further, the respective phases of each of the secondary windings 22–27 are delta-connected, and the nodes of the delta connections of the respective windings 22–27 construct output terminals for three-phase signals U1–W1, . . . and U6–W6.

Next, there will be described the operation of the embodiment of this invention shown in FIGS. 1 and 2.

First, when three-phase currents IU–IW at a source frequency of 60 Hz are supplied to the primary winding 21, the U-phase primary winding 21U through the W-phase primary winding 21W are excited, and the three-phase signals U1–W1, . . . and U6–W6 are respectively delivered from the secondary windings 22–27. These three-phase signals U1–W1, . . . and U6–W6 are supplied to the corresponding cycloconverter circuits 7–9, and are converted into three-phase outputs Iu–Iw at a desired frequency as in the prior-art described before.

In general, D.C. components are contained in the three-phase signals U1–W1, . . . and U6–W6. It is known, however, that since these signals are three-phase balanced currents, the resultant currents thereof do not contain any D.C. components.

In this case, the resultant currents based on the secondary windings 22U–27U, 22V–27V and 22W–27W are respectively applied to the main legs 13U, 13V and 13W of the iron core 13, so that no D.C. excitation develops. For this reason, no D.C. components appear in the respective three-phase currents IU–IW to be supplied to the primary windings 21U–21W, either, so that the corresponding main legs 13U–13W are not subjected to D.C. excitation at all. Accordingly, even when the three-phase transformer 20 is operated so as to establish an output frequency fo equal to ½ of the input frequency fi, it does not give rise to the obstacles as explained before, and hence, it is an economical setup suited to the operation of the cycloconverter.

Although the embodiment has been described in reference to a three-phase, three-legged iron core 13, an equal effect is achieved even with a three-phase five-legged iron core having side legs.

Moreover, although the respective phases of each of the secondary windings 22–27 have been delta-connected so as to obtain the three-phase signals U1–W1, . . . and U6–W6, the secondary windings 22U–22W, . . . and 27U–27W may well be star-connected respectively.

As described above, according to this invention, each of three primary windings to which three-phase currents are individually applied as inputs is furnished with six secondary windings, and D.C. components contained in respective three-phase cancelled, so as to prevent any D.C. component in currents which are supplied to the primary winding wound around the main legs of the respective phases. The invention is therefore effective for economically providing a three-phase transformer for a cycloconverter which is free from D.C. excitation without regard to the frequency of outputs from cycloconverter circuits.

What is claimed is:

1. A three-phase transformer for a cycloconverter comprising three inputs, each input for receiving one of the phases of a three-phase input current, and eighteen outputs, the outputs comprising six output groups, each output group having three members, for supplying six three-phase output currents, wherein each of said inputs comprises one of the primary windings of said transformer and each of said outputs comprises one of eighteen secondary windings of said transformer, six of said secondary windings being electromagnetically coupled to each of said primary windings, and wherein each output group includes three interconnected secondary windings, each of said secondary windings in an output group being electromagnetically coupled to a different one of said three primary windings whereby DC components of the three-phase current supplied in each of said output groups cancel.

2. The transformer of claim 1 wherein said interconnected secondary windings in each output group are electrically interconnected in a delta configuration to supply a three-phase output current.

3. The transformer of claim 1 wherein said interconnected secondary windings in each output group are electrically interconnected in a star configuration to supply a three-phase output current.

* * * * *